United States Patent [19]

Woller

[11] Patent Number: 4,991,690

[45] Date of Patent: Feb. 12, 1991

[54] PORTABLE HUNTING LADDER

[76] Inventor: John A. Woller, 2311 College St., SE., Decatur, Ala. 35601

[21] Appl. No.: 495,596

[22] Filed: Mar. 19, 1990

[51] Int. Cl.[5] ..... E06C 1/10; E06C 7/08

[52] U.S. Cl. ..... 182/93; 182/178; 182/214; 182/194

[58] Field of Search ..... 182/93, 178, 194, 187, 182/214, 151

[56] References Cited

U.S. PATENT DOCUMENTS

| | | | |
|---|---|---|---|
| 405,195 | 6/1889 | Ayres | 182/178 |
| 644,265 | 2/1900 | Thirion . | |
| 782,539 | 2/1905 | Bihl . | |
| 896,569 | 8/1908 | Neal . | |
| 1,422,654 | 7/1922 | Bilger | 182/178 |
| 1,545,348 | 7/1925 | Walder | 182/178 |
| 3,630,314 | 12/1971 | Bamburg | 182/178 |
| 3,995,714 | 12/1976 | Brookes | 182/178 |
| 4,086,980 | 5/1978 | Shortes | 182/178 |
| 4,231,448 | 11/1980 | Jensen | 182/151 |
| 4,411,335 | 10/1983 | Forrester . | |
| 4,552,247 | 11/1985 | Purdy | 182/178 |
| 4,742,888 | 5/1988 | Amacker . | |
| 4,762,200 | 8/1988 | Andrews et al. . | |

FOREIGN PATENT DOCUMENTS

| | | | |
|---|---|---|---|
| 7879 | 9/1955 | Fed. Rep. of Germany | 182/178 |

*Primary Examiner*—Reinaldo P. Machado

*Attorney, Agent, or Firm*—Burns, Doane, Swecker & Mathis

[57] ABSTRACT

A portable hunting ladder has a base section and one or more slidably connected ladder sections. Each ladder section has a stand-off device and a device for securing the section to the tree being climbed. The ladder sections are fabricated from tubular cross-section members while the rungs are fashioned from U-shaped channel elements. Each ladder section has a length which is less than the height of a man so that it can be secured while standing on the next lower section. The ladder rungs are only wide enough for one foot.

24 Claims, 4 Drawing Sheets

PORTABLE HUNTING LADDER

BACKGROUND AND SUMMARY OF THE INVENTION

The present invention relates generally to devices for facilitating the ability to climb. More particularly, this invention concerns portable ladders of the type used by sportsmen.

Sportsmen often desire elevated locations for observation. In the case of hunters, the purpose for as elevated observation location can be for spotting potential game, for enhanced concealment from potential game, for an improved vantage point for shooting at potential game, or for some combination of those purposes.

Since trees occur naturally in areas where sportsmen and hunters typically seek elevated observation locations, sportsmen and hunters have, in the past, used available trees for that purpose. Climbing trees can be difficult, especially if there are no relatively low hanging branches. In addition, if the sportsman or hunter wants to take a rifle, shotgun, hunting bow, spotting scope, or other device to the elevated observation location, it may be even more difficult to climb a tree.

To aid sportsmen and hunters to climb trees, various kinds of ladders have been proposed in the past. For example, an access ladder has been suggested which uses a plurality of sections each having a single tubular support, a plurality of cantilever-mounted rungs extending from the support, and a hook, chain, turnbuckle arrangement to secure prongs of the ladder section to a tree. See, U.S. Pat. No. 4,411,335, issued to Forrester on Oct. 25, 1983. Such cantilever-mounted rungs are prone to bending and resultant danger to the sportsman or hunter. A singular tubular support does not provide lateral stability and can easily sink into topsoil. Prongs which penetrate tree bark are undesirable not only since they deface trees but also because they expose trees to insect infestation and damage.

Another ladder assembly has been proposed using progressively narrower, pivotally connected ladder sections with a tree stand, a stand-off strut in the middle of one ladder section, and a chain with turnbuckle arrangement to attach the strut to a tree. See, U.S. Pat. No. 4,742,888, issued to Amacker on May 10, 1988. Such a stand-off strut does not provide significant lateral stability to the ladder. Moreover, the assembly is quite heavy since it is unnecessarily wide. Furthermore, the assembly has a fixed length due to its pivotal arrangement which restricts its usefulness where the height to be climbed is variable.

A tree ladder is also known having a pair of sections with cantilever mounted rungs and a limb-engaging hook assembly. See, U.S. Pat. No. 4,762,200, issued to Andrews et al. on Aug. 9, 1988. The central tubular support and cantilevered rungs are objectionable as noted above. And, the fixed length restricts utility, as noted above.

There are other types of light-weight ladder structures such as, for example, the fire escape ladders of U.S. Pat. No. 782,539, issued to Bihl on Feb. 14, 1905, U.S. Pat. No. 644,265, issued to Thirion on Feb. 27, 1900, and U.S. Pat. No. 896,569 issued to Neal on Aug. 18, 1908.

From the foregoing discussion, it will be seen that the need continues to exist for a light-weight portable ladder assembly which overcomes problems of the type discussed above.

An extremely rigid, light-weight, portable ladder with substantial lateral stability and having capacity to be erected while being climbed has been found. This portable ladder features one or more ladder sections which can be telescopically or slidably connected together and to a base section. The ladder sections feature a pair of generally parallel rails spaced from one another by a distance selected to be larger than the width of a typical boot and less than twice the width of a typical boot, each rail being a predetermined length with a tubular cross section, and having an end adapted to telescopically or slidably join with an end of a similar rail. In addition, each ladder section has a plurality of rungs extending between and connected to each of the parallel rails, with one rung being attached closely adjacent to the first ends of the generally parallel rails. For attaching the ladder section to, for example, a tree, a stand-off means and a securing means are provided. The stand-off means is attached to the ladder section closely adjacent to the one rung, positions the ladder section at a predetermined distance from the tree, and resists lateral movement of the ladder section relative to such tree is attached to the ladder section closely adjacent the one rung. The securing assembly attaches to the ladder section and secures it to the tree at the location of the stand-off device.

The base section has a pair of legs spaced farther from one another than the distance between the parallel rails of the ladder section to provide lateral stability to whole ladder assembly. In addition, the base section has a pair of parallel connector elements shaped to telescopically or slidably join with corresponding lower ends of the parallel rails of the ladder section.

The light-weight characteristics of this portable ladder assembly are achieved by keeping the length of the rungs only wide enough for one boot, and by using the stability of a tree to resist bending and buckling of the ladder structure.

Additional lateral stability relative to the tree, without environmental damage, is attained by providing a pair of tree-engaging surfaces supported by the ladder section and convergent toward the ladder section, along with a strap to secure the ladder section to the tree.

In order to provide a ladder with variable length, the ladder sections have a length selected to correspond to the average height of a man's chest above the ground. With this arrangement, the first ladder section can be attached to the tree and the next ladder section can be telescopically or slidably fixed to the first ladder section. Then, the sportsman or hunter can climb to the top of the first ladder section and secure the top of the second ladder section to the tree before any weight is even applied to the second ladder section. The procedure can then be repeated with as many ladder sections as are required to climb a particular tree or reach a particular elevated observation location.

BRIEF DESCRIPTION OF THE DRAWINGS

Many objects and advantages of the present invention will be apparent to those of ordinary skill in the art when this application is read in conjunction with the accompanying drawings wherein like reference numerals have been applied to like elements and wherein.

DETAILED DESCRIPTION OF THE PREFERRED EMBODIMENTS

Figure 1:
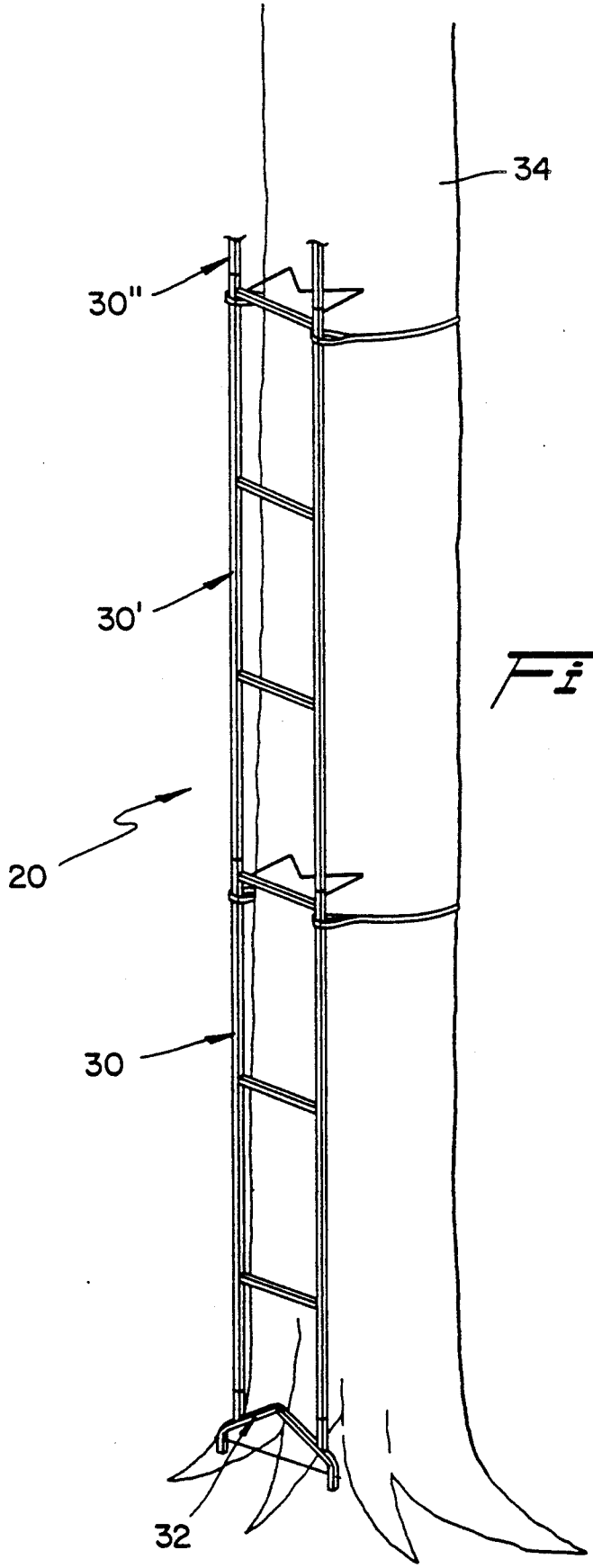
FIG. 1 is a perspective view of a portable hunting ladder according to the present invention in use.

To aid sportsmen, hunters, and others having a desire to climb trees in remote locations, a ladder 20 (see FIG. 1) is provided which is portable, light-weight, variable length, and capable of assembly while it is being climbed.

In accordance with the present invention, the ladder 20 includes a plurality of ladder sections 30, 30', 30'' (a portion of which is illustrated), and a base section 32. The base section 32 and the adjacent ladder section 30 are telescopically joined with a slidable joint. Likewise, the ladder sections 30, 30', and 30'' are telescopically joined with a slidable joint. Depending upon the height to be climbed, additional ladder sections 30 can be added as desired.

Each ladder section 30, 30', 30'' is identical. Accordingly, it will suffice to describe just one of the ladder sections 30 in detail, it being understood that all other ladder sections are identical. Each ladder section 30 (see FIG. 2) has a pair of generally parallel side rails 34, 36. These generally parallel rails 34, 36 are preferably fashioned from 1 inch by 1 inch square 18 gage steel tubing in order to get a suitable strength along with a suitable light weight. Alternatively, the rails could be fashioned from other metals, including without limitation aluminum, or from plastic materials, which may or may not be reinforced, such as with fibers of glass, metal, or synthetic materials.

For reasons to be explained more fully below, these generally parallel rails 34, 36 have a predetermined length which will permit assembly of one ladder section 30 to another ladder section 30 which has already been secured to a tree. That predetermined length is selected to approximately correspond to the average height of a man's chest above the ground when standing. More particularly, that predetermined length is about four feet or in the range of 45–55 inches. With the ladder section 30 having generally parallel rails 34, 36 with lengths in this range, an average person can be entirely supported by a lower ladder section 30 while attaching a new ladder section 30 to the tree being climbed. This gives a considerable safety advantage over the known portable ladder constructions.

At one end 38, 40, each of the generally parallel rails 34, 36 has a swaged portion. These swaged portions have the same cross-sectional shape as the associated generally parallel rails 34, 36 but are sufficiently reduced in cross-sectional dimensions that the swaged portions can be slidably received in the other end 42, 44 of an adjacent ladder section 30. By making the swaged portions with a length that is about three times the nominal cross-sectional dimension of the generally parallel rails 34, 36, the telescopic connection between adjacent ladder section 30 is able to resist considerable twisting between adjacent ladder section 30 while it also assures that the adjacent ladder section 30 is in proper longitudinal alignment.

Preferably, the generally parallel rails 34, 36 are laterally spaced from one another by a distance that generally exceeds the width of an average man's boot. However, that lateral spacing between the generally parallel rails 34, 36 is selected so as to be less that twice the width of an average man's boot. The intention of this spacing between the generally parallel rails 34, 36 is to provide adequate space for one foot while climbing, but not for both feet. Selection of this relatively narrow spacing allows the generally parallel rails 34, 36 to be small in cross-sectional dimensions but still be adequate to provide the necessary bending strength and buckling strength.

Extending between the generally parallel rails 34, 36 are a plurality of rungs 48, 50, 52. One rung 48 is located at the ends 38, 40 of the generally parallel rails 34, 36 closely adjacent to the swaged portions. The other rungs 50, 52 are spaced along the generally parallel rails 34, 36 such that there is a substantially identical space between the rungs 48, 50, 52 themselves and between the rung 52 and the bottom ends 42, 44 of the generally parallel rails 34, 36.

Figure 3:
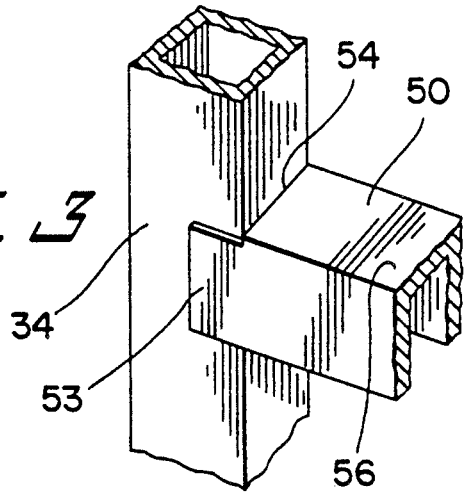
FIG. 3 is a detail view of one embodiment for attaching rungs to rails of the ladder section.

As best seen from FIG. 3, each rung preferably is fashioned from a channel section having a U-shape in cross section. The channel may be fashioned from a metal, such as steel or aluminum, or from a reinforced plastic material. The open side of the channel section faces downwardly in the ladder section 30 so that a relatively flat surface 56 is provided for the sportsman or hunter to step on. Moreover, the use of a channel section further reduces the weight of the portable ladder assembly as compared with solid rung constructions.

Each rung 48, 50, 52 is appropriately attached to the generally parallel rails 34, 36 so as to yield a rigid connection between the rungs and the generally parallel rails 34, 36. For example (see FIG. 3), the end of each rung 50 can be provided with longitudinally extending ears 53 which cooperate to define a notch 54 in the top surface of the rung 50. The notch 54 has a width corresponding to the outside dimension of the rail 34 so that the rail 34 will be partially received in the notch. Each ear 53 is then welded, bonded, or mechanically fastened, preferably at multiple places, to the associated rail 34.

Figure 4:
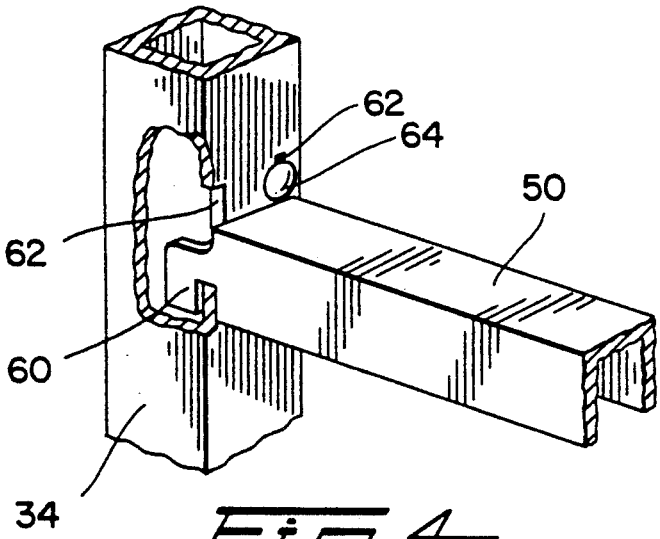
FIG. 4 is a detail view of a second embodiment for attaching rungs to rails of the ladder section.

There are, of course, other ways that will occur to one skilled in the art to effect the connection between the rungs 48, 50, 52 and the generally parallel rails 34, 36. For example, an alternate arrangement might fashion a hook 60 (see FIG. 4) on each side of the rung 50. By also providing suitably positioned and sized slots 62 on the generally parallel rails 34, 36, the hooks 60 of the rungs can be readily connected to the generally parallel rails 34, 36. In the event this construction is desired, some means should also be provided to occupy the unused portion of the slots 62 to prevent accidental disengagement of the rung 50 from the rail 34. A rivet 64 would provide a suitable device to accomplish that function. Likewise, it would be possible to use screws in the slots, or some transverse member through the rail 34 above the hooks 60 or even through the hooks 60 to prevent the disengagement. This embodiment using hooks to connect the rungs to the rails permits the ladder section 30 to be even more compact when it is being carried.

In order to provide a comfortable space for the sportsman's or hunter's boot between the rungs of the ladder section 30 and the tree being climbed, a suitable stand-off means 70 is provided for each ladder section 30. Preferably, the stand-off means 70 is located closely adjacent to the top rung 48 and is securely attached either to the generally parallel rails 34, 36 or to the top rung 48 itself.

While the stand-off means 70 can have various forms, it is desirable that the stand-off means 70 provide a pair of contact surfaces 72, 74 which are convergent toward the rails generally parallel rails 34, 36 and toward the adjacent rung 48. Since tree trunks tend to be generally circular in cross section, those convergent contact surfaces 72, 74 tend to center the ladder section 30 on the centerline of the tree and tend to resist movement of the ladder section 30 laterally or sideways with respect to the centerline of the tree. Preferably the convergent contact surfaces 72, 74 define a recess which is spaced from the ladder section 30 by about 60% to 80% of the maximum projection of the stand-off means 70 so that there is still space to comfortably accommodate the user's boot between the ladder section 30 and the tree. As illustrated, the stand-off means 70 may have the shape of the letter "M". Moreover, the stand-off means 70 may be fabricated from a rod or tube, of steel or aluminum, having a diameter on the order of ¼ inch.

To attach the ladder section 30 to the tree, a securing means 80 is provided at the upper end of the ladder section 30, closely adjacent to the upper rung 48. The securing means 80 is connected to each of the generally parallel rails 34, 36 and has a length sufficient to wrap around the tree to which the ladder section 30 is to be attached. The securing means 80 can have various forms. For example, a strap 82 can be employed. For purposes of this invention, a strap 82 is intended to include a conventional rope, a woven member with or without buckles or clasps, a flexible cable, and similar items. The strap 82 can be one piece that is secured at each end to a corresponding one of the generally parallel rails 34, 36, or it can be two pieces with each piece being secured to a corresponding one of the generally parallel rails 34, 36 and the two pieces being connected with a knot, a buckle, a clasp, or the like. Alternatively, the securing means 80 can be a chain with turnbuckle or the like.

Figure 5:
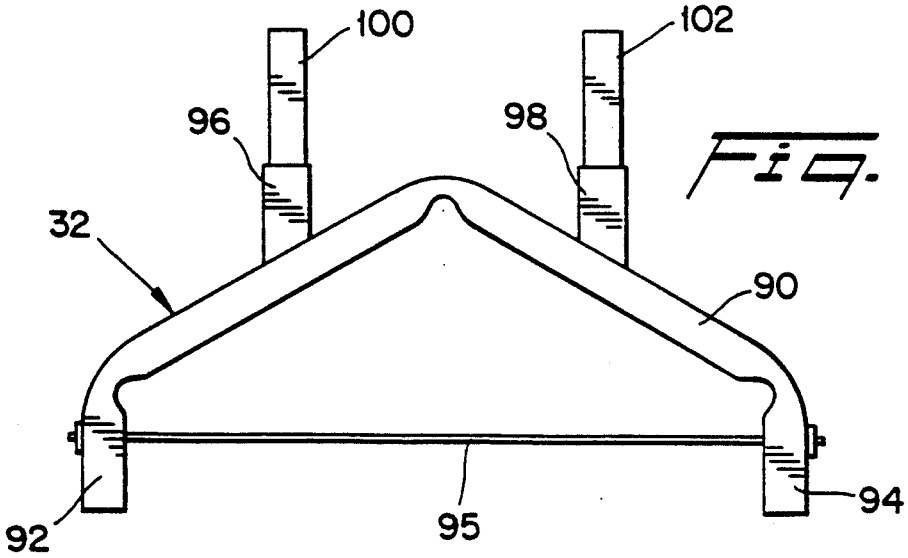
FIG. 5 is an enlarged elevational view of a base section of the portable hunting ladder of FIG. 1.

The base section 32 (see FIG. 5) preferably includes a structural member 90 which may, for example, be fabricated from a 1 inch by 1 inch square 18 gage steel tube. As with the generally parallel rails, the structural member 90 can also be fashioned from other tubular cross-sectional shapes, and from other materials such as metals, including without limitation aluminum, and plastics, reinforced or non-reinforced. The member 90 is formed to define a pair of legs 92, 94 which are generally parallel and which are spaced by a distance which is at least twice as large as the distance between the generally parallel rails 34, 36. This spacing provides lateral stability against tipping. In addition, the legs 92, 94 are connected by a splaying restraint means 95 which prevents the legs from splaying. The splaying restraint means 95 may be as simple as a rod extending between and attached to the legs 92, 94. As will be seen from FIG. 5, the splaying restraint means 95 and the member 90 cooperate to define a triangularly shaped element giving inherent rigidity.

A pair of connector elements 96, 98 is attached to the member 90 by welding or other suitable attachment technique. The connector elements 96, 98 are generally parallel and are spaced by a distance which corresponds to the spacing between the generally parallel rails 34, 36. In addition, each connector element 96, 98 is provided with a reduced cross section portion 100, 102 that is sized and shaped so as to be slidably received in the bottom ends of the generally parallel rails 34, 36 of an adjacent ladder section 30.

Figure 2:
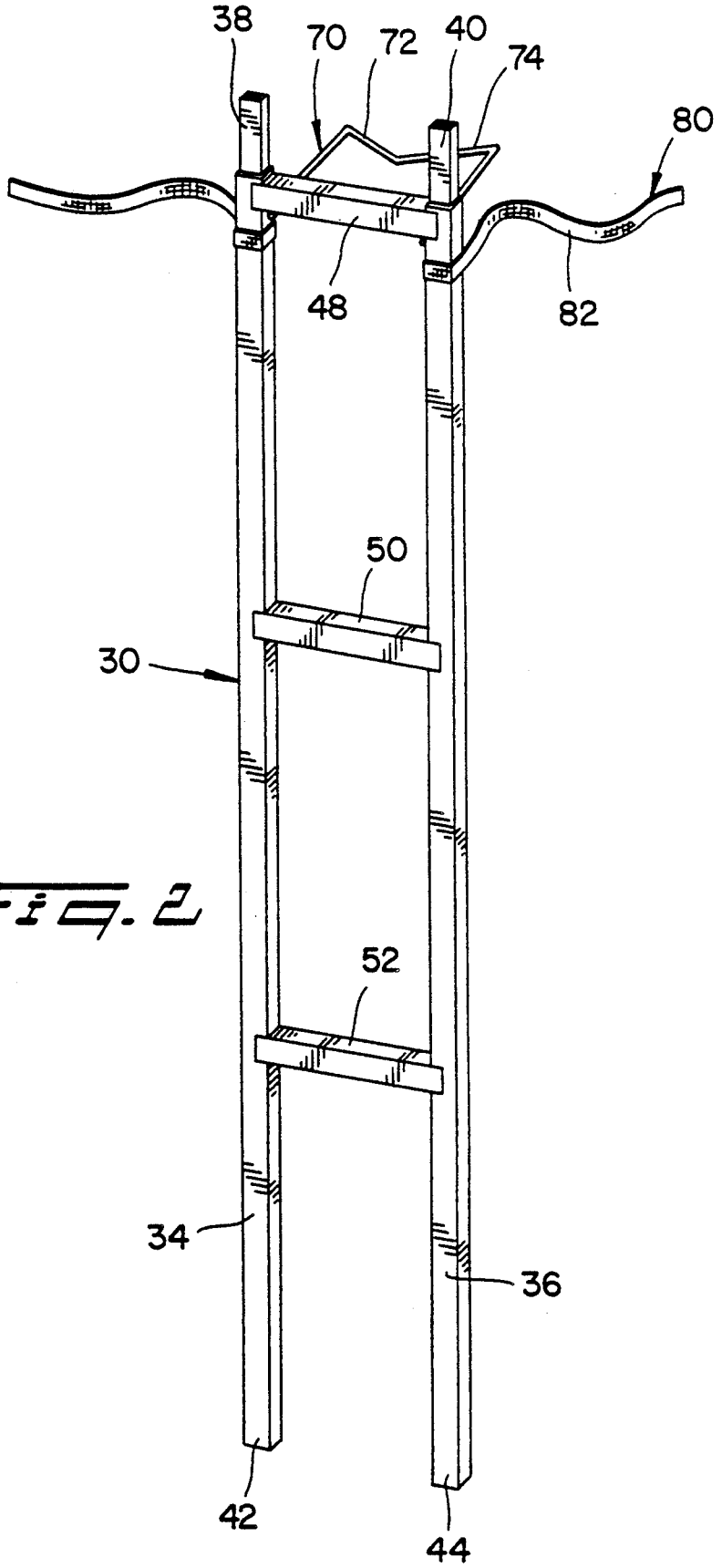
FIG. 2 is an enlarged perspective view of one section of the portable hunting ladder of FIG. 1.

In use, the base section 32 (FIG. 5) is first slidably connected to a ladder section 30 (FIG. 2). The assembly is then positioned at the base of a tree to be climbed with the tree between the convergent surfaces 72, 74 of the stand-off means 70. Then the securing means 80 is connected so that it holds the ladder section 30 firmly against the tree. The sportsman or hunter then lifts the next ladder section 30 and slides it onto the swaged portions 38, 40 of the first ladder section 30. By climbing to the top rung 48 of the first ladder section 30, the sportsman or hunter can fasten the securing means 80 of the second ladder section 30 around the tree, thereby making the second ladder section 30 safe to use.

Then, the next ladder section 30 is slidably attached to the swaged portions 38, 40 of the second ladder section 30. By climbing to the top rung 48 of the second ladder section 30, the securing means 80 of the next ladder section 30 can be secured around the tree making the third ladder section 30 safe for use.

Additional sections can be sequentially added as needed to attain the desired elevated observation position.

Alternatively, the desired number of ladder sections 30 can be longitudinally assembled on the ground with the stand-off means 70 of each ladder section 30 extending to the same side. Then, the assembly can be placed against the tree to be climbed. The securing means 80 of the lowermost ladder section 30 is attached around the tree making the lowermost ladder section 30 secure. By climbing to the top rung 48 of the lowermost ladder section 30, the securing means 80 of the next ladder section 30 can be attached around the tree to make that ladder section 30 safe and secure. Similarly, each remaining ladder section 30 can be made secure as the ladder is climbed.

While the swaged ends 38, 40 of the ladder section 30 have been shown and described as being at the top of the ladder section 30, there is no reason why the swaged ends could not be provided at the bottom end of each generally parallel rails 34, 36. Moreover, while the swaged portions 38, 40 have been described to have a reduced cross section, they could just as readily be enlarged in cross section dimensions. The important point here is that the swaged portion slidably receive, or be slidably received by, the generally parallel rails 34, 36 of the adjacent ladder section 30.

It will also be noted that the angular relationship between the legs 92, 94 (FIG. 5) and the member 90 provides an effective limitation to the depth that the ladder assembly will sink into soft soil. Likewise, the splay restraint 95 provides an addition resistance to sinking of the ladder assembly in soft soil.

Figure 6:
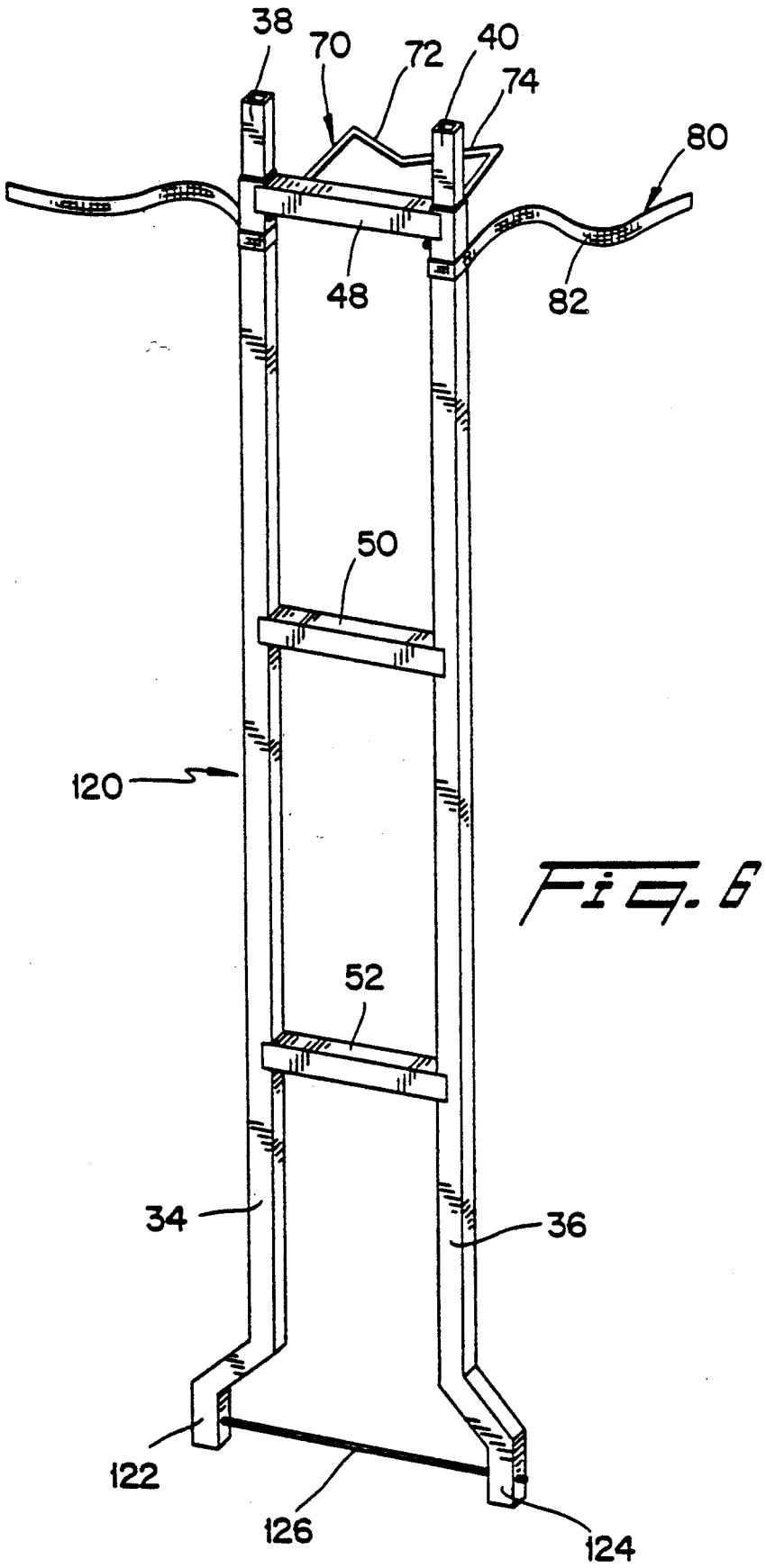
FIG. 6 is a perspective view of an alternate bottom section for the portable hunting ladder.

In the embodiment described above, the ladder sections 30 are identical to one another. The base section 32 is a separate piece. It is, however, within the scope of the present invention to make a ladder section 120 (see FIG. 6) with an integral base section.

Such a ladder section 120 may be identical in all other respects to the ladder section 30 (see FIG. 2) described above. The substantially parallel rails 34, 36 of the ladder section 120 (see FIG. 6) each have a corresponding outwardly bent portion 122, 124 that defines a leg. Those legs are spaced apart by a distance which is about two times the distance between the rails 34, 36 at the location of the rungs to provide stability to the ladder section 120 against side-to-side tipping.

A suitable splay restraint 126 may interconnect the two legs 122, 124 to help resist forces that could tend to bend the legs which the ladder section 120 is being used. In addition, the splay restraint 126 helps resist penetration of the bottom of the section into soft soil.

In use, the lower ladder section 120 having the integral base section is first attached to a tree, as described above. Then a ladder section 30 (see FIG. 2) is slidably mounted on the upper end of the lower ladder section, and attached to the tree, as described above.

It should now be apparent that there has been provided, in accordance with this invention, a novel and improved portable hunting ladder that overcomes problems of the type discussed above in connection with known devices. Moreover, it will be apparent to those skilled in the art that numerous modifications, variations, and equivalents for elements of the invention exist which do not materially depart from the spirit and scope of the invention. Accordingly, it is expressly intended that all such modifications, variations, substitutions, and equivalents which fall within the spirit and scope of the invention as defined in the appended claims be embraced thereby.

What is claimed is:

1. A portable hunting ladder for use in climbing trees comprising:

at least one ladder section having:

a pair of generally parallel rails spaced from one another by a distance selected to be larger than the width of a typical boot and less than twice the width of a typical boot, each rail being a predetermined length with a tubular cross section, and an end adapted to slidably join with an end of a similar rail, a plurality of rungs extending between and connected to each of the parallel rails, one rung being attached closely adjacent to the first ends of the generally parallel rails, stand-off means for positioning the ladder section at a predetermined distance from a support and for resisting sideways movement of the ladder section relative to such support, being attached to the ladder section closely adjacent the one rung, and securing means attached to the ladder section for securing the ladder section at the location of the stand-off means to such support; and a base section having a pair of legs spaced farther from one another than the distance between the parallel rails of the ladder section, including a pair of parallel connector elements shaped to slidably join with corresponding second ends of the parallel rails of the ladder section.

2. The portable hunting ladder of claim 1 wherein the generally parallel rails and the rungs are fabricated from metal.

3. The portable hunting ladder of claim 2 wherein the generally parallel rails and the rungs are fabricated from steel.

4. The portable hunting ladder of claim 2 wherein the generally parallel rails and the rungs are fabricated from aluminum.

5. The portable hunting ladder of claim 1 wherein the generally parallel rails and the rungs are fabricated from reinforced plastic.

6. The portable hunting ladder of claim 1 wherein the distance between the generally parallel rails is about six inches.

7. The portable hunting ladder of claim 1 wherein the length of the generally parallel rails is selected to correspond with the average height of a man's chest when standing.

8. The portable hunting ladder of claim 7 wherein the length of the generally parallel rails is about four feet.

9. The portable hunting ladder of claim 1 wherein the end of each rail is swaged to a smaller cross section than the rail cross section so that the swaged cross section can slidably receive the rail end of an adjacent ladder section.

10. The portable hunting ladder of claim 1 wherein two rungs are provided, with generally uniform spacing between all the rungs and the other end of the rails.

11. The portable hunting ladder of claim 10 wherein each of the rungs has a U-shaped cross section.

12. The portable hunting ladder of claim 11 wherein each end of each rung is welded to the adjacent one of the generally parallel rails.

13. The portable hunting ladder of claim 11 wherein each end of each rung is bonded to the adjacent one of the generally parallel rails.

14. The portable hunting ladder of claim 11 wherein each end of each rung is mechanically fastened to the adjacent one of the generally parallel rails.

15. The portable hunting ladder of claim 11 wherein each rail has a plurality of slots corresponding to the number of rungs, each rung has a hook member at each end sized to be received in a corresponding one of the slots, and a locking means is inserted into each slot adjacent the corresponding hook to prevent accidental disengagement between the hook and the rail.

16. The portable hunting ladder of claim 1 wherein the stand-off means has an M-shape and extends generally perpendicularly from the generally parallel rails so as to define contact surfaces which converge toward the ladder section.

17. The portable hunting ladder of claim 16 wherein the stand-off means is fashioned from a rod.

18. The portable hunting ladder of claim 16 wherein the stand-off means is fashioned from a tube.

19. The portable hunting ladder of claim 1 wherein the securing means includes a flexible member and is attachable to each of the two generally parallel rails.

20. The portable hunting ladder of claim 19 wherein the flexible member is a strap.

21. The portable hunting ladder of claim 1 wherein the base includes a splaying restraint extending between the two legs.

22. The portable hunting ladder of claim 1 wherein the connector elements of the base as sized and spaced to receive the corresponding second ends of the parallel rails of the ladder section.

23. A portable hunting ladder for use in climbing trees comprising:

at least one ladder section having:

a pair of generally parallel rails spaced from one another by a distance selected to be larger than the width of a typical boot and less than twice the width of a typical boot, each rail being a predetermined length with a tubular cross section, and an end adapted to slidably join with an end of a similar rail, a plurality of rungs extending between and connected to each of the parallel rails, one rung being attached closely adjacent to the first ends of the generally parallel rails, stand-off means for positioning the ladder section at a predetermined distance from a support and for resisting sideways movement of the ladder section relative to such support, being attached to the ladder section closely adjacent the one rung, securing means attached to the ladder section for securing the ladder section at the location of the stand-off means to such support, and a pair of legs spaced farther from one another than the distance between the parallel rails of the ladder section, and integrally formed with the rails of the ladder section.

24. The portable hunting ladder of claim 23 further including:

at least one ladder section having:

a pair of generally parallel rails spaced from one another by a distance selected to be larger than the width of a typical boot and less than twice the width of a typical boot, each rail being a predetermined length with a tubular cross section, and an end adapted to slidably join with an end of a similar rail, a plurality of rungs extending between and connected to each of the parallel rails, one rung being attached closely adjacent to the first ends of the generally parallel rails, stand-off means for positioning the ladder section at a predetermined distance from a support and for resisting sideways movement of the ladder section relative to such support, being attached to the ladder section closely adjacent the one rung, and securing means attached to the ladder section for securing the ladder section at the location of the stand-off means to such support.

* * * * *